US010146171B2

(12) United States Patent
Sakuwa et al.

(10) Patent No.: US 10,146,171 B2
(45) Date of Patent: Dec. 4, 2018

(54) IMAGE FORMING APPARATUS CAPABLE OF PREVENTING WASTE TONER FROM ENTERING INTO PROCESSING UNIT

(71) Applicant: Sharp Kabushiki Kaisha, Osaka (JP)

(72) Inventors: Tohru Sakuwa, Osaka (JP); Yasuhiro Nishimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1 day.

(21) Appl. No.: 15/280,245

(22) Filed: Sep. 29, 2016

(65) Prior Publication Data

US 2017/0102664 A1 Apr. 13, 2017

(30) Foreign Application Priority Data

Oct. 8, 2015 (JP) ..... 2015-200213

(51) Int. Cl.
*G03G 21/10* (2006.01)

(52) U.S. Cl.
CPC ..... *G03G 21/105* (2013.01)

(58) Field of Classification Search
CPC ... G03G 21/105; G03G 21/10; G03G 15/0898
See application file for complete search history.

(56) References Cited

U.S. PATENT DOCUMENTS 4,089,600 A * 5/1978 Ito ..... G03G 15/30 250/324
4,377,334 A * 3/1983 Nishikawa ..... G03G 15/0942 399/103
4,630,653 A * 12/1986 Kan ..... G03G 21/105 141/256
5,113,227 A * 5/1992 Miyasaka ..... G03G 21/105 198/674
5,999,791 A * 12/1999 Ogawa ..... G03G 21/007 399/102
2003/0016964 A1* 1/2003 Terai ..... G03G 15/0898 399/98
2004/0253022 A1* 12/2004 Arai ..... G03G 21/105 399/253
2005/0260018 A1* 11/2005 Jang ..... G03G 21/12 399/358

(Continued)

FOREIGN PATENT DOCUMENTS

JP 07257625 A * 10/1995
JP 2012-185335 A 9/2012

*Primary Examiner* — Sevan A Aydin
(74) *Attorney, Agent, or Firm* — Renner Otto Boisselle & Sklar, LLP

(57) ABSTRACT

In an image forming apparatus, a cleaning portion has a discharge pipe that guides toner that has been collected from a peripheral surface of a photoreceptor drum as waste toner to the outside of a process unit. The discharge pipe is drawn from a side surface of the process unit and includes at a tip portion a discharge port that discharges the waste toner. A restricting portion is arranged on a side surface of the discharge pipe, between a position corresponding to an insertion port and the discharge port, and restricts a flow of air moving from the discharge port to the insertion port. The insertion port is provided on a same surface as the side surface of the process unit from which the discharge pipe is drawn. And the insertion port is configured to be inserted by a cleaning tool for the electrode.

8 Claims, 12 Drawing Sheets

(56) References Cited

U.S. PATENT DOCUMENTS

| | | | | |
|---|---|---|---|---|
| 2006/0165440 | A1* | 7/2006 | Adachi | G03G 15/0844 399/254 |
| 2007/0065196 | A1* | 3/2007 | Baker | G03G 21/105 399/358 |
| 2008/0063427 | A1* | 3/2008 | Ikado | G03G 21/12 399/106 |
| 2009/0074466 | A1* | 3/2009 | Kwon | G03G 15/0898 399/252 |
| 2011/0076056 | A1* | 3/2011 | Sato | G03G 21/12 399/120 |
| 2011/0176817 | A1* | 7/2011 | Kim | G03G 21/12 399/12 |
| 2011/0262174 | A1* | 10/2011 | Gumbe | G03G 15/0898 399/92 |
| 2012/0213567 | A1* | 8/2012 | Sato | G03G 21/105 399/358 |
| 2013/0149005 | A1* | 6/2013 | Mori | G03G 15/0131 399/123 |
| 2015/0147090 | A1* | 5/2015 | Sato | G03G 21/169 399/110 |
| 2016/0085207 | A1* | 3/2016 | Sato | G03G 21/1853 399/111 |
| 2016/0209805 | A1* | 7/2016 | Mori | G03G 15/0131 |
| 2016/0246245 | A1* | 8/2016 | Sato | G03G 21/1853 |

* cited by examiner

IMAGE FORMING APPARATUS CAPABLE OF PREVENTING WASTE TONER FROM ENTERING INTO PROCESSING UNIT

CROSS REFERENCE

This Nonprovisional application claims priority under 35 U.S.C. § 119(a) on Patent Application No. 2015-200213 filed in Japan on Oct. 8, 2015, the entire contents of which are hereby incorporated by reference.

BACKGROUND OF THE INVENTION

1. Field of the Invention

The present invention relates to an image forming apparatus, and more particularly to the art of preventing contamination of various components of the image forming apparatus due to waste toner.

2. Description of Related Art

An electrophotographic image forming apparatus is provided with a process unit that forms a toner image used as a printing image. In the process unit, to begin with, a charging portion charges the peripheral surface of a photoreceptor drum. The charged peripheral surface of the photoreceptor drum is irradiated with laser light, which forms an electrostatic latent image on the peripheral surface of the photoreceptor drum. Subsequently, a developing portion visualizes the electrostatic latent image and thus forms a toner image. The toner image is transferred onto a paper sheet for example through a transfer belt.

In the above apparatus, the charging portion has a wire, a saw-toothed electrode, or the like as an electrode that generates discharge necessary for the charging of the photoreceptor drum. On the other hand, if a stain is attached to such an electrode, the charging performance will be reduced. Therefore, a technique to clean an electrode has been proposed. For example, a technique in which a cleaning device is built in a process unit and cleaning is automated is proposed (see Japanese Unexamined Patent Application Publication No. 2012-185335, for example). In addition, as cleaning technique, cleaning is performed manually such that a cleaning tool is inserted into a charging portion from the outside of a process unit.

However, when the cleaning is performed manually, the process unit needs to be provided with an insertion port into which the cleaning tool is inserted. In other words, the charging portion of the process unit comes to communicate with the outside of the process unit through the insertion port.

On the other hand, in the process unit, the toner that remained on the peripheral surface of the photoreceptor drum after the toner image is transferred is collected and is discharged as waste toner to the outside of the process unit. Specifically, the process unit is provided with a discharge pipe for guiding the waste toner to the outside of the process unit, and the discharge pipe is drawn from the process unit and includes at a tip portion a discharge port for discharging the waste toner. The waste toner discharged from the discharge port falls down, and is supplied to a waste toner tank.

However, when the waste toner falls from the discharge port into the waste toner tank, air is blown out of the inlet port of the waste toner tank due to the influence of the waste toner. Therefore, a problem has occurred such that waste toner leaks out of the waste toner tank with the blown air. In addition, in order to make it easier to clean an electrode and perform maintenance such as replacement of a waste toner tank, the insertion port is, in many cases, provided on the same surface as the side surface of the process unit from which the discharge pipe is drawn. Therefore, the waste toner that has leaked out of the waste toner tank enters from the insertion port and, as a result, a problem that the electrode of the charging portion is contaminated has occurred.

SUMMARY OF THE INVENTION

An image forming apparatus according to preferred embodiments of the present invention includes a process unit including: a photoreceptor drum, a charging portion having an electrode that charges the peripheral surface of the photoreceptor drum, a cleaning portion that collects toner remaining on the peripheral surface of the photoreceptor drum, and a restricting portion. The cleaning portion has a discharge pipe that guides toner that has been collected from the peripheral surface of the photoreceptor drum as waste toner to the outside of the process unit. The discharge pipe is drawn from a side surface of the process unit and includes at a tip portion a discharge port that discharges the waste toner. The restricting portion is arranged on a side surface of the discharge pipe, between a position corresponding to an insertion port and the discharge port, and restricts a flow of air moving from the discharge port to the insertion port. The insertion port is provided on a same surface as the side surface of the process unit from which the discharge pipe is drawn. And the insertion port is configured to be inserted by a cleaning tool for the electrode.

The foregoing and other features and attendant advantages of the present invention will become more apparent from the reading of the following detailed description of the preferred embodiments with reference to the attached drawings.

DETAILED DESCRIPTION OF THE EMBODIMENTS

[1] First Preferred Embodiment

Figure 1:
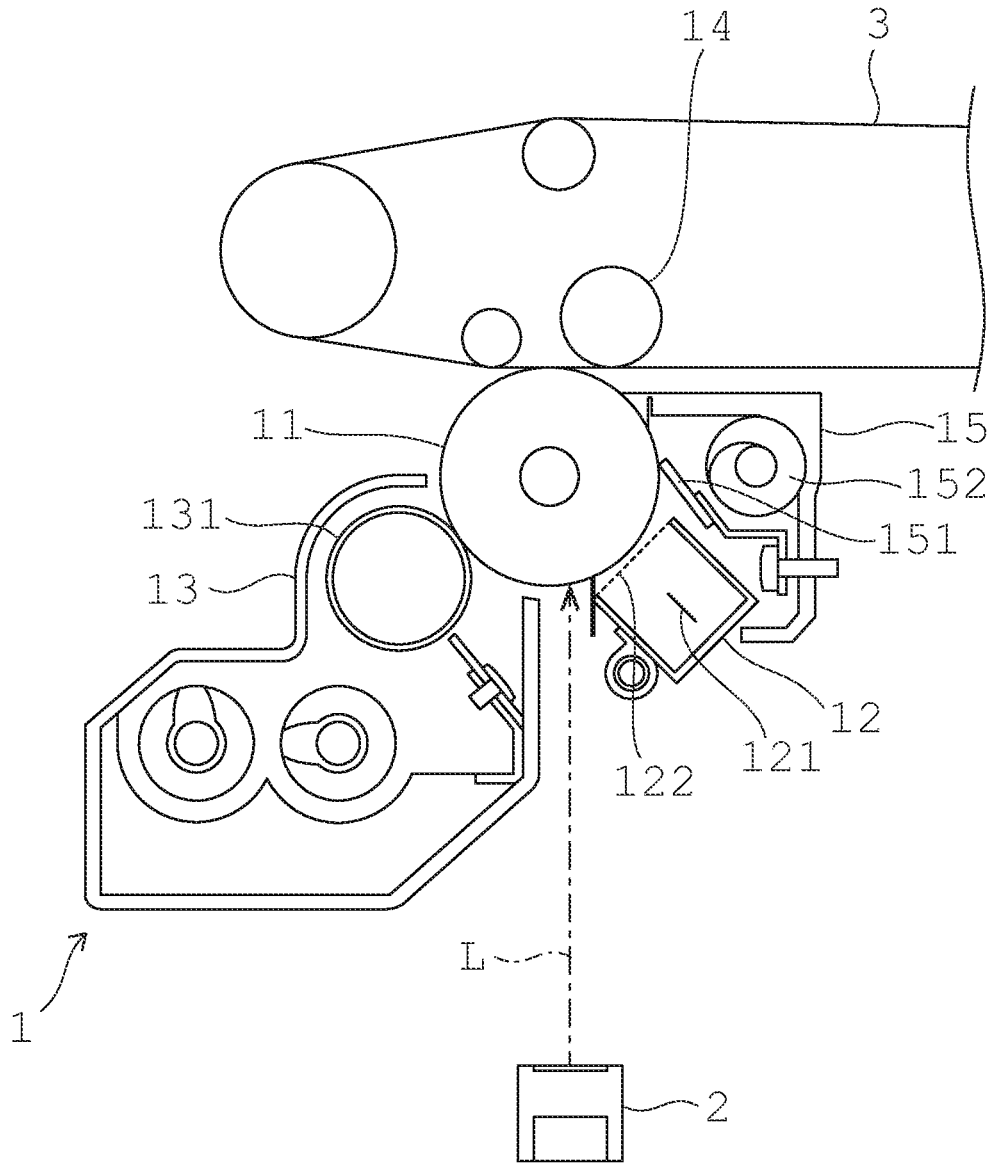
FIG. 1 is a conceptual view illustrating a main part of an image forming apparatus.

An image forming apparatus performs image printing to a paper sheet by performing an electrophotographic image forming process based on image data. Specifically, as illustrated in FIG. 1, the image forming apparatus is provided with a process unit 1, an exposure device 2, and an intermediate transfer belt 3 as the main parts of the image forming apparatus.

The process unit 1 has a photoreceptor drum 11, a charging portion 12, a developing portion 13, a primary transfer roller 14, and a cleaning portion 15. The photoreceptor drum 11 is an electrostatic latent image bearing member.

The charging portion 12 has an electrode 121 that generates discharge necessary for the charging of the photoreceptor drum 11, and a grid 122 that controls the charge potential. The electrode 121 is a wire, a saw-toothed electrode, or the like and extends in the direction of the axis of rotation of the photoreceptor drum 11, at a position spaced from the peripheral surface of the photoreceptor drum 11. Then, the electrode 121, by being applied with a bias, generates the discharge and causes the peripheral surface of the photoreceptor drum 11 to be charged by the discharge. The charged peripheral surface of the photoreceptor drum 11 is irradiated with laser light L from the exposure device 2, and thus an electrostatic latent image in accordance with the image data is formed on the peripheral surface of the photoreceptor drum 11.

Figure 2A:
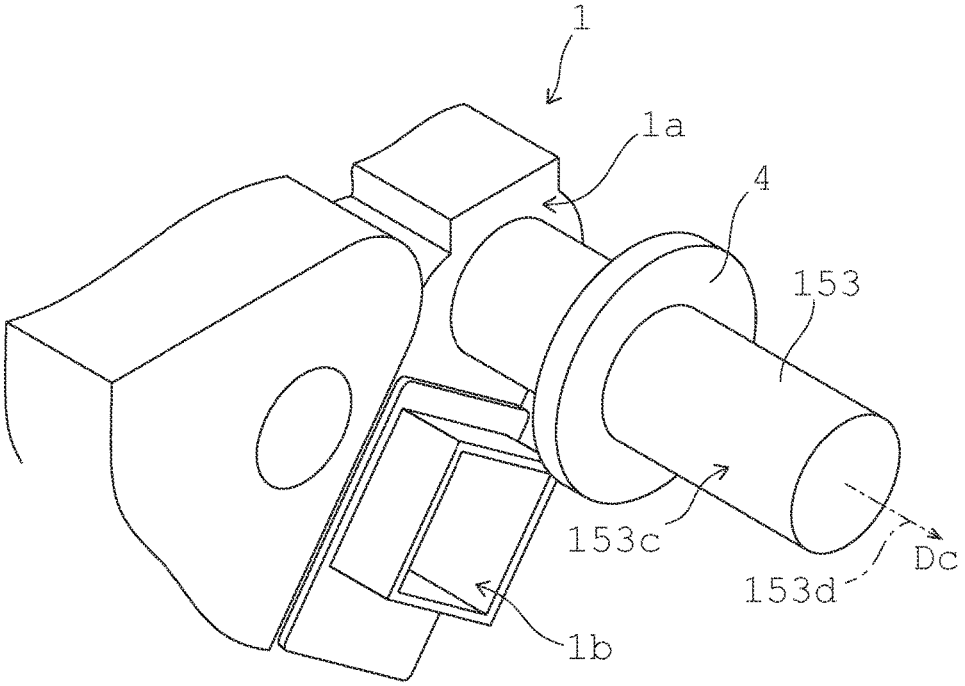
FIG. 2A and FIG. 2B are respectively a perspective view and a side view partially illustrating an external appearance of a process unit with which the image forming apparatus according to a first preferred embodiment is provided.
Figure 2B:
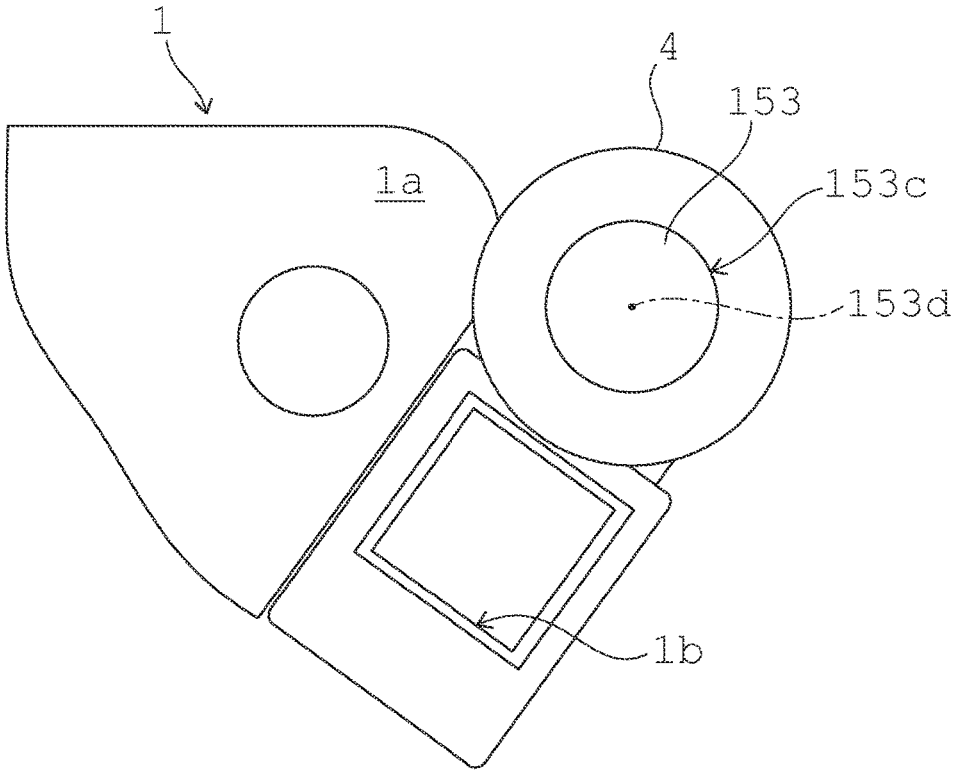

The image forming apparatus according to the present preferred embodiment is an apparatus in which the cleaning of the electrode 121 needs to be performed manually such that a cleaning tool is inserted into the charging portion 12 from the outside of the process unit 1. Therefore, the process unit 1, as illustrated in FIG. 2A and FIG. 2B, is provided with an insertion port 1*b* into which a cleaning tool is inserted. In other words, the charging portion 12 of the process unit 1 comes to communicate with the outside of the process unit 1 through the insertion port 1*b*.

The developing portion 13 visualizes the electrostatic latent image formed on the peripheral surface of the photoreceptor drum 11 and forms a toner image. Specifically, the developing portion 13, by applying a bias (developing bias) to a developing roller 131, moves the toner adhering to the peripheral surface of the developing roller 131 to the peripheral surface of the photoreceptor drum 11, in a development position. Accordingly, the electrostatic latent image is visualized and a toner image is formed. The formed toner image is carried by rotation of the photoreceptor drum 11 to a position in which transfer (primary transfer) to the intermediate transfer belt 3 is performed.

The primary transfer roller 14 transfers the toner image born on the photoreceptor drum 11 to the intermediate transfer belt 3. Specifically, the primary transfer roller 14, by being applied with a bias (transfer bias), causes the toner configuring the toner image to generate static electricity and moves the toner image to the intermediate transfer belt 3 using the static electricity.

The toner image transferred onto the intermediate transfer belt 3 is carried by the circular motion of the intermediate transfer belt 3 to a position in which transfer (secondary transfer) to a paper sheet is performed. Subsequently, the toner image is transferred onto the paper sheet by a secondary transfer roller (not illustrated) and securely fixed onto the paper sheet by a fixing portion.

The cleaning portion 15 collects toner remaining on the peripheral surface of the photoreceptor drum 11 after the primary transfer. Accordingly, preparation for a subsequent image forming process is performed. When the remaining toner is collected, other attachments (such as dust) onto the peripheral surface of the photoreceptor drum 11 are also collected.

Specifically, the cleaning portion 15 has a blade 151 and a carrying screw 152. The blade 151 is installed in a state in which the tip of the blade 151 is made in contact with the peripheral surface of the photoreceptor drum 11, and scrapes the toner remaining on the peripheral surface of the photoreceptor drum 11. The cleaning portion 15, as illustrated in FIG. 2A and FIG. 2B, further has a discharge pipe 153, and the toner that has been collected by the blade 151 is discharged as waste toner to the outside of the process unit 1 through the discharge pipe 153. In other words, the discharge pipe 153 forms a passage that guides waste toner to the outside of the process unit 1. More specific description will be made as follows.

Figure 3:
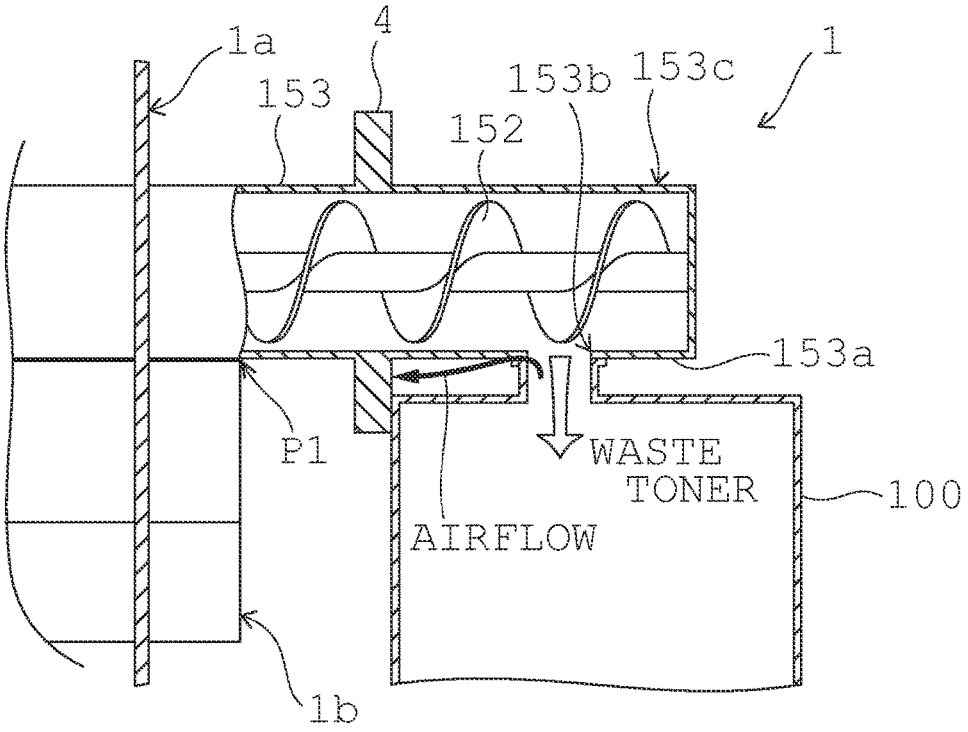
FIG. 3 is a broken view illustrating a flow of air at a time of discharge of waste toner.

As illustrated in FIG. 3, the discharge pipe 153 is drawn out from a side surface 1*a* of the process unit 1, and is provided with a discharge port 153*b* discharging waste toner. The discharge port 153*b* is provided downward at the tip end portion 153*a* of the discharge pipe 153. Then, the toner (waste toner) that has been collected by the blade 151, by the rotation of the carrying screw 152, is guided into the discharge pipe 153 and is carried up to the discharge port 153*b* in the inside of the discharge pipe 153. Subsequently, the waste toner falls from the discharge port 153*b* and is discharged to the outside of the process unit 1. The discharge pipe 153 has a cylindrical shape so that waste toner is efficiently carried by rotation of the carrying screw 152.

The insertion port 1*b* for cleaning is provided on the same surface as the side surface 1*a* of the process unit 1 from which the discharge pipe 153 is drawn. In other words, the insertion port 1*b* and the discharge port 153*b* are arranged in positions close to each other. In the present preferred embodiment, the insertion port 1*b* is provided in a position obliquely downward with respect to the position from which the discharge pipe 153 is drawn (see FIG. 2B). In other words, the position of the insertion port 1*b* is a position from which the waste toner discharged from the discharge port 153*b* enters easily.

In such a configuration, on the side surface 153*c* of the discharge pipe 153, a flange portion 4 is provided between a position P1 corresponding to the insertion port 1*b* and the discharge port 153*b* and has an annular shape (see FIG. 3). The flange portion 4 functions as a restricting portion that significantly reduces or prevent a flow of air from the discharge port 153*b* to the insertion port 1*b*. In the present preferred embodiment, the outer edge shape of the flange portion 4 is a circle, and the flange portion 4 is provided on the discharge pipe 153 so that the center of the circle matches the central axis 153*d* of the discharge pipe 153 (see FIG. 2B). In addition, the flange portion 4 is formed integrally with the discharge pipe 153. The outer edge shape of the flange portion 4 is not limited to a circle and may be in various shapes (such as an oval shape, a polygon, and a polygon of which the corner is rounded).

In the image forming apparatus, a waste toner tank 100 is arranged so that the edge that defines an inlet port of the waste toner tank 100 may be in close contact with the edge of the discharge port 153*b* (see FIG. 3). However, when the waste toner falls from the discharge port 153*b* into the waste toner tank 100, due to the influence of the waste toner, air is blown out of the inlet port of the waste toner tank 100, and the air is blown out of a space between the two edges. Then, the waste toner leaks out of the waste toner tank 100 with the blown air.

Under such a state, according to the flange portion 4, a flow of the air blown out of the waste toner tank 100 is significantly reduced or prevented (see FIG. 3). Specifically, the flow of air is able to be more easily blocked by the flange portion 4. Accordingly, even if the waste toner leaks out of the waste toner tank 100 with the flow of air, scattering of the waste toner is significantly reduced or prevented by the flange portion 4. Therefore, the waste toner is less likely to reach the insertion port 1*b*, and, as a result, entering of the waste toner from the insertion port 1*b* is significantly reduced or prevented.

Figure 4A:
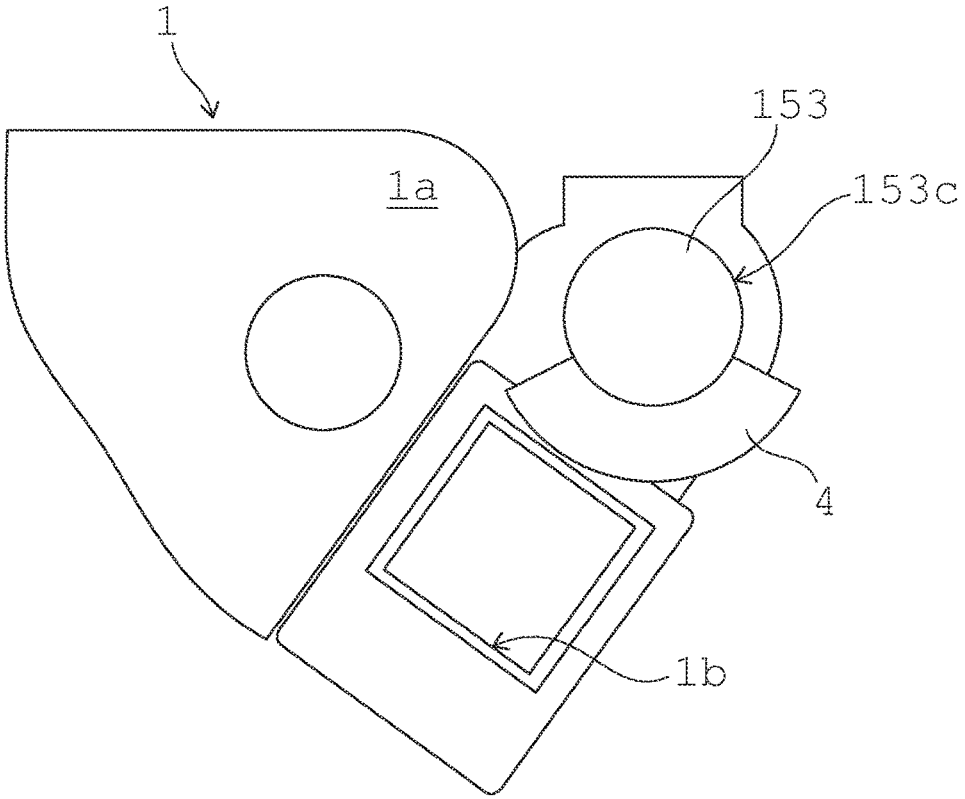
FIG. 4A is a conceptual view illustrating a modification example of a flange portion.

If the flow of the air blown out of the waste toner tank 100 is able to be significantly reduced or prevented, the flange portion 4 does not necessarily need to have a shape that surrounds the discharge pipe 153. In other words, the flange portion 4 may be provided in a position in which it becomes possible to significantly reduce or prevent the flow of air efficiently. As an example, as illustrated in FIG. 4A, the flange portion 4 may be partially provided around the discharge pipe 153.

Figure 4B:
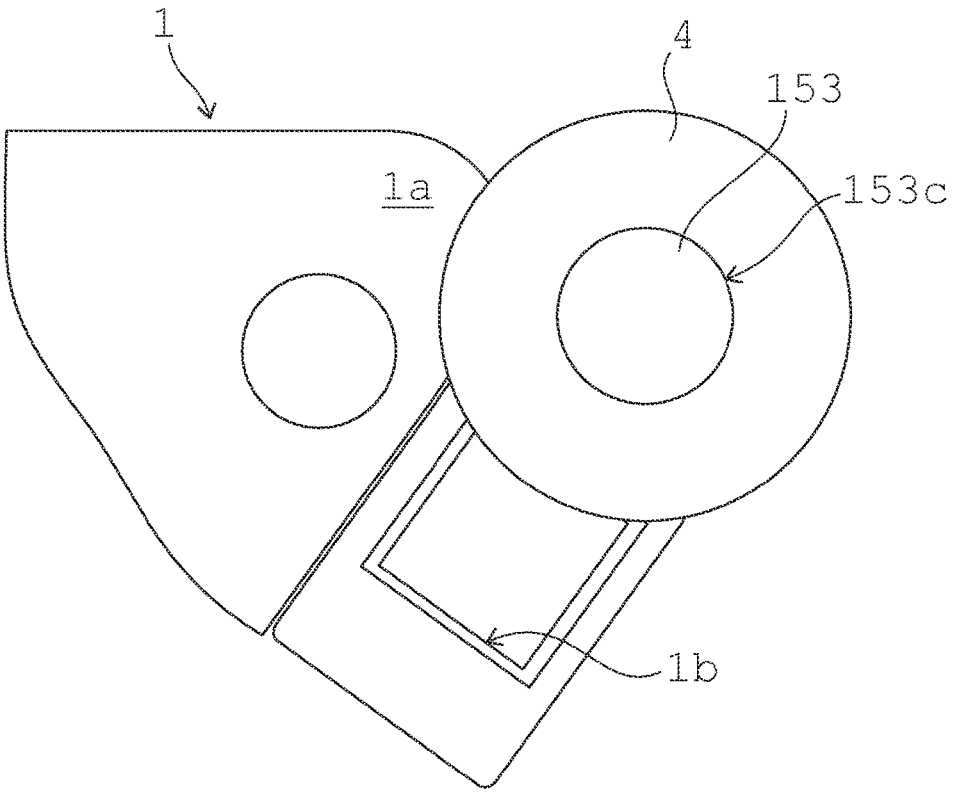
FIG. 4B is a conceptual view illustrating another modification example of the flange portion.

In addition, as illustrated in FIG. 4B, when viewed from the direction Dc of the central axis (see FIG. 2A) of the discharge pipe 153, the flange portion 4 may have a shape expanding to a position overlapping a part of the insertion port 1*b*. However, the shape may preferably be a shape that does not prevent the cleaning tool from being inserted into the insertion port 1*b*.

Further, the flange portion 4, as illustrated in FIG. 3, may also preferably function as a positioning portion that determines the installation position of the waste toner tank 100. By the flange portion 4 functioning as a positioning portion, the waste toner tank 100 and the flange portion 4 are more likely to be in close contact with each other at the time of installation of the waste toner tank 100. Therefore, the waste toner tank 100 significantly reduces or prevents the flow of air in an auxiliary manner, and, as a result, the flow of air will be significantly reduced or prevented efficiently.

[2] Second Preferred Embodiment

Figure 5A:
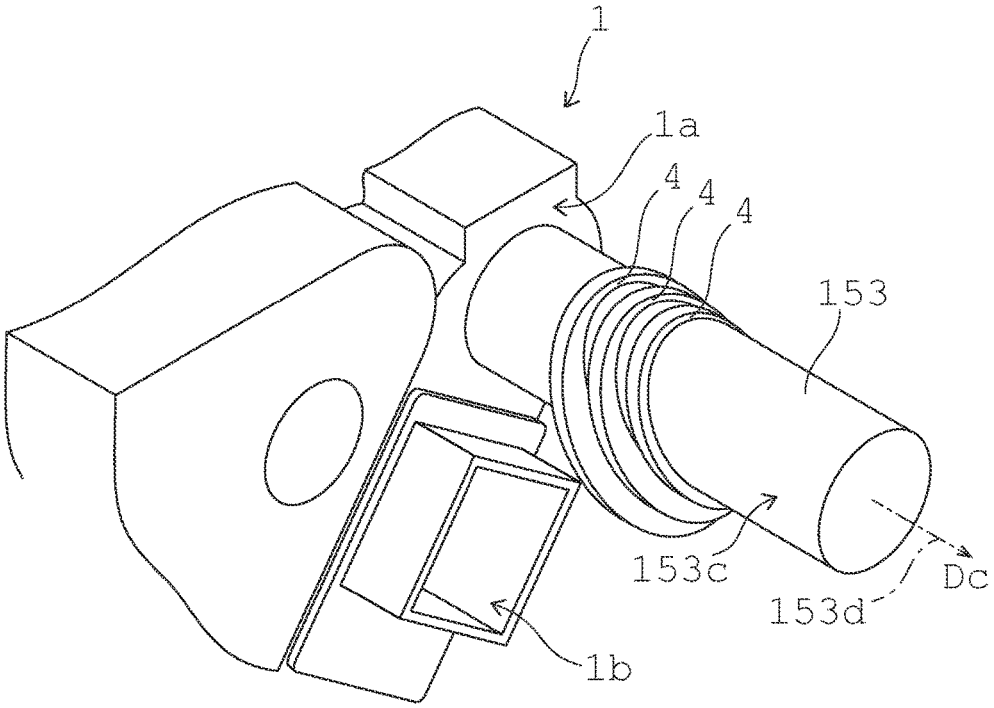
FIG. 5A and FIG. 5B are respectively a perspective view and a side view partially illustrating an external appearance of a process unit with which the image forming apparatus according to a second preferred embodiment is provided.
Figure 5B:
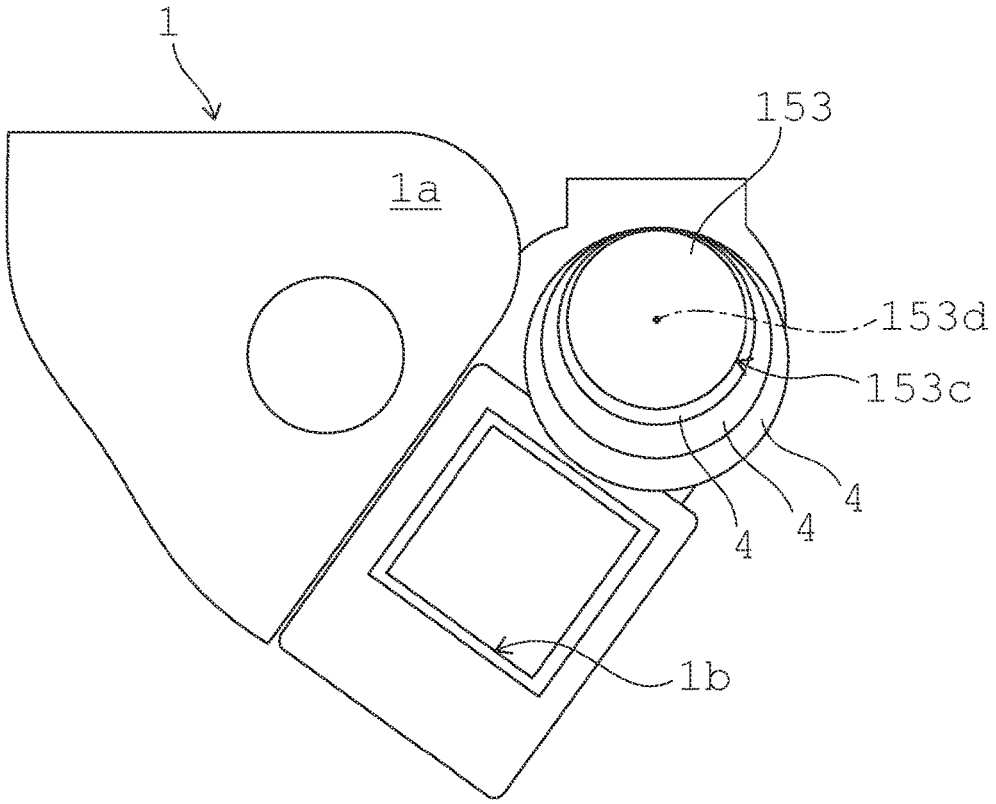

As illustrated in FIG. 5A and FIG. 5B, the flange portion 4 may preferably extend obliquely around the central axis 153*d* of the discharge pipe 153, along the side surface 153*c* of the discharge pipe 153. Specifically, the flange portion 4 may preferably extend obliquely around the central axis 153*d* of the discharge pipe 153 from a position adjacent to the discharge port 153*b* in such a manner that a part of the flange portion 4 located farther from the discharge port 153*b* has a smaller distance from the part to the side surface 1*a* of the process unit 1 (see FIG. 6).

Figure 6:
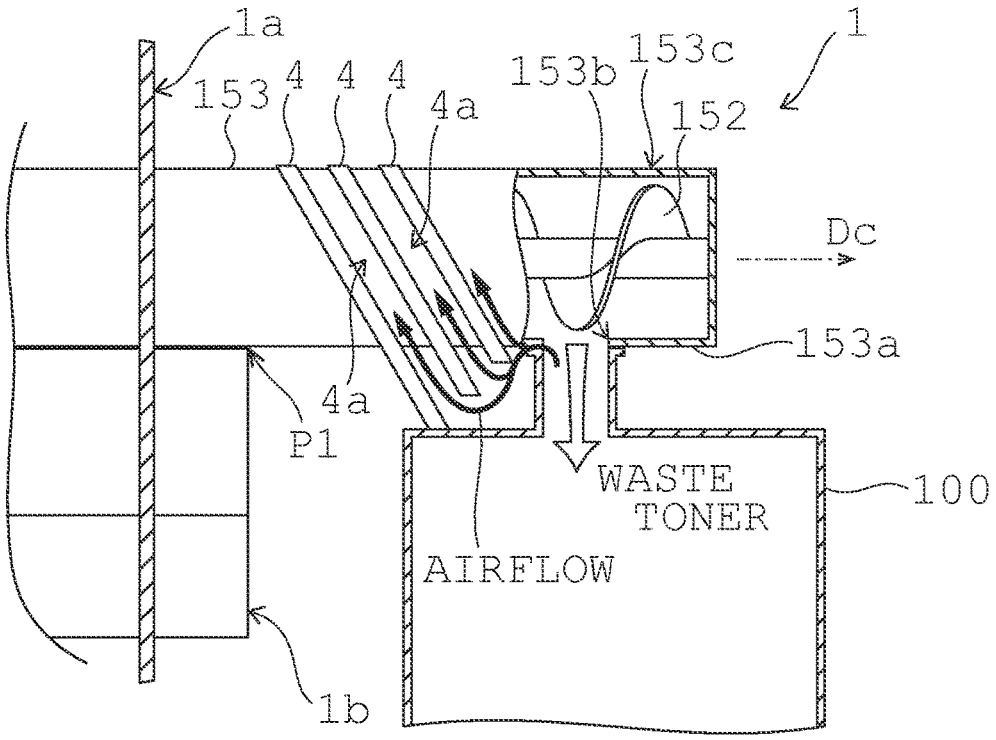
FIG. 6 is a conceptual view illustrating a flow of air at the time of discharge of waste toner.

Further, in the present preferred embodiment, the flange portion 4 extending obliquely in such a manner may preferably be provided in each of three positions spaced from one another in the direction Dc of the central axis of the discharge pipe 153 (see FIG. 6). Then, between two flange portions 4 located adjacent to each other, a flow path 4*a* may preferably be formed and regulate the flow of air. The flange portion 4 may be provided in each of positions that are not limited to the three positions spaced from one another in the direction Dc of the central axis of the discharge pipe 153.

Specifically, as illustrated in FIG. 5B and FIG. 6, among the three flange portions 4, the flange portion 4 from which a distance to the side surface 1*a* of the process unit 1 is smaller has a larger outer edge. In addition, when attention is paid to the two flange portions 4 located adjacent to each other, one flange portion 4 from which the distance to the side surface 1*a* of the process unit 1 is smaller expands farther downward than a position corresponding to the lower end position of the other flange portion 4. Accordingly, as illustrated in FIG. 6, the air blown out of the waste toner tank 100 is likely to be guided to the flow path 4*a*.

In the present preferred embodiment, all the three flange portions 4 each have an annular shape of which the outer edge shape is a circle when viewed from the direction Dc of the central axis of the discharge pipe 153 (see FIG. 5B). Then, the flange portion 4 from which a distance to the side surface 1*a* of the process unit 1 is smaller has a larger radius of the circular outer edge. Moreover, the centers of the outer edges of all the flange portions 4 are shifted downward from the central axis 153*d* of the discharge pipe 153.

According to the configuration of the second preferred embodiment, the flow of the air blown out of the waste toner tank 100 is significantly reduced or prevented by each of the three flange portions 4. In addition, the flow of the air blows out of the waste toner tank 100 is regulated by the flow path 4*a* formed of the flange portions 4. In other words, as illustrated in FIG. 6, the flow path 4*a* causes the flowing direction of air to head for a direction different from the direction heading for the insertion port 1*b*. Accordingly, even if the waste toner leaks out of the waste toner tank 100 with the flow of air, the waste toner is less likely to reach the insertion port 1*b*, and, as a result, entering of the waste toner from the insertion port 1*b* is significantly reduced or prevented.

At the time of installation of the waste toner tank 100, the waste toner tank 100 and the flange portion 4 may preferably be in close contact with each other, as illustrated in FIG. 6. Accordingly, the air blown out of the waste toner tank 100 will be efficiently guided to the flow path 4*a*.

[3] Third Preferred Embodiment

Figure 7A:
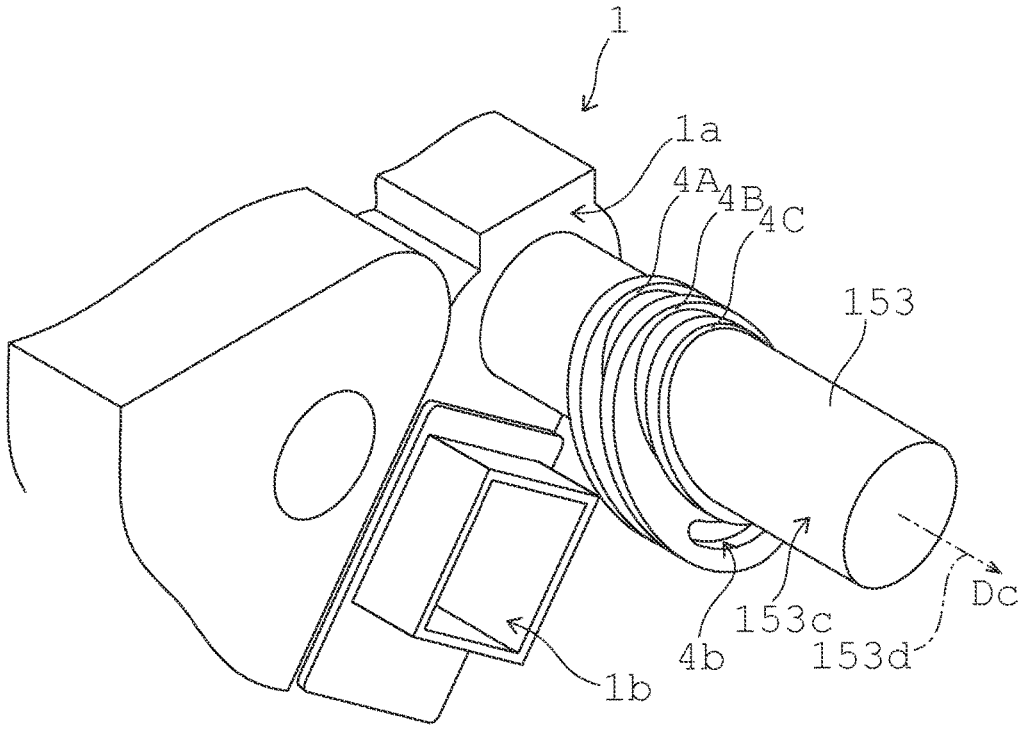
FIG. 7A and FIG. 7B are respectively a perspective view and a side view partially illustrating an external appearance of a process unit with which the image forming apparatus according to a third preferred embodiment is provided.
Figure 7B:
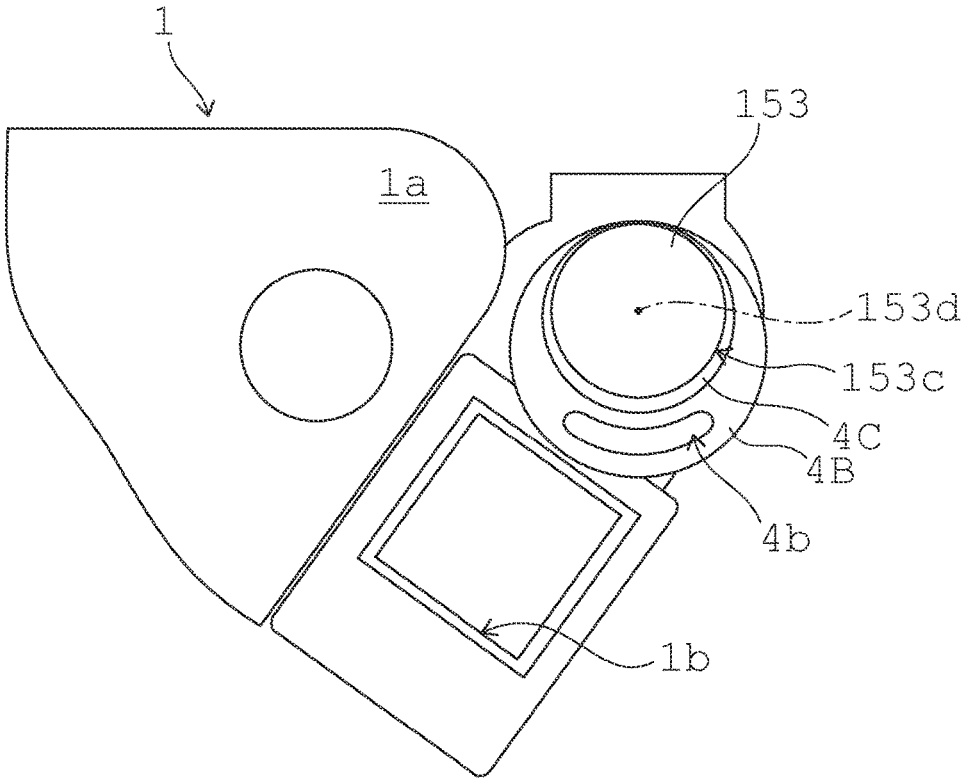
Figure 8:
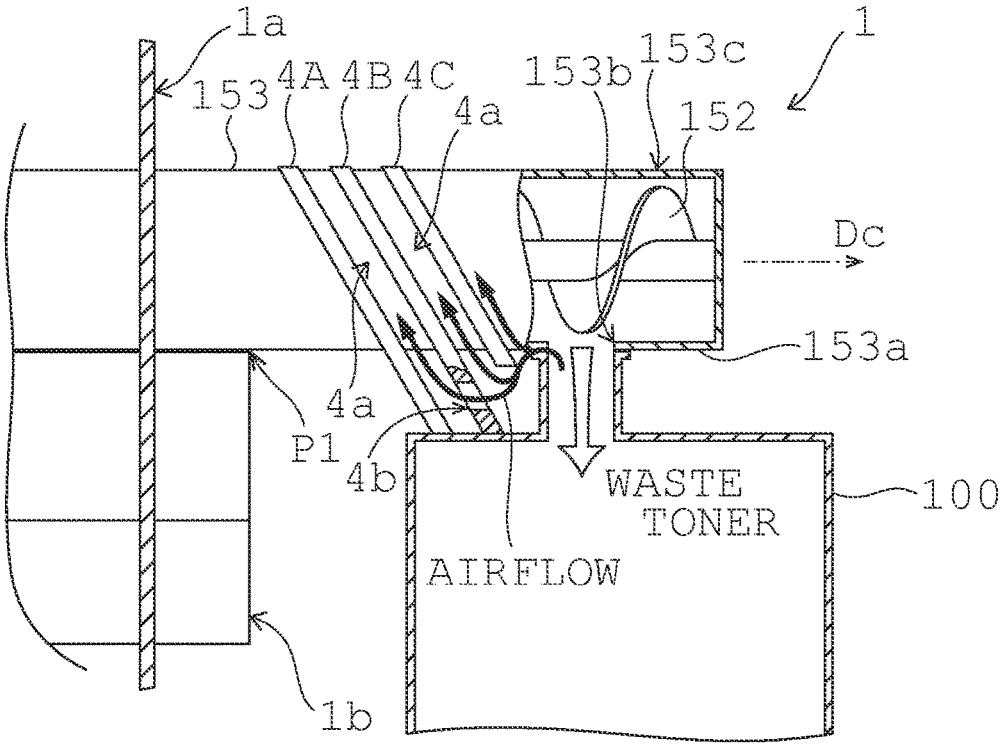
FIG. 8 is a conceptual view illustrating a flow of air at the time of discharge of waste toner.

The three flange portions 4 that have been described in the second preferred embodiment may have a configuration to be described below as illustrated in FIG. 7A to FIG. 8. Hereinafter, the flange portion 4 from which the distance to the side surface 1*a* of the process unit 1 is smallest is referred to as a first flange portion 4A, the flange portion 4 located in the middle is referred to as a second flange portion 4B, and the flange portion 4 from which the distance to the side surface 1*a* of the process unit 1 is largest is referred to as a third flange portion 4C.

In the present preferred embodiment, the second flange portion 4B may preferably be provided with a through hole 4*b* that allows air to pass. In addition, the first flange portion 4A may preferably be located adjacent to the second flange portion 4B on the process unit side and may expand to a position capable of receiving a flow of the air having passed the through hole 4*b*. Accordingly, the air that has passed the through hole 4*b* is able to be easily guided to the flow path 4*a*. In order to make such a configuration possible, in the present preferred embodiment, the second flange portion 4B configured to be of the same shape and of the same size as the first flange portion 4A is employed. The shape and size of the second flange portion 4B do not necessarily need to be the same as the first flange portion 4A and may be variously modified.

According to the configuration of the third preferred embodiment, the flow of the air blown out of the waste toner tank 100 is significantly reduced or prevented by each of the three flange portions 4A to 4C. In particular, the second flange portion 4B expands farther downward as compared with the flange portion 4 in the second preferred embodiment, and thus the flow of air is able to be more easily blocked by the second flange portion 4B. In addition, a part of air blown out of the waste toner tank 100 passes the through hole 4*b* provided in the second flange portion 4B, and the air that has passed is able to be more easily guided to the flow path 4*a* formed between the first flange portion 4A and the second flange portion 4B. Therefore, the function that restricts the flow of air is efficiently exhibited. In other words, as illustrated in FIG. 8, the flow path 4*a* causes the flowing direction of air to head for a direction different from the direction heading for the insertion port 1*b*. Accordingly, even if the waste toner leaks out of the waste toner tank 100 with the flow of air, the waste toner is less likely to reach the insertion port 1*b*, and, as a result, entering of the waste toner from the insertion port 1*b* is significantly reduced or prevented.

The flange portion 4 may be provided in each of positions that are not limited to the three positions spaced from one another in the direction Dc of the central axis of the discharge pipe 153. In addition, the through hole 4*b* may be provided in at least one of flange portions 4 provided in the discharge pipe 153. The through hole 4*b* may preferably be provided in at least one of the flange portions 4 other than the flange portion 4 (the first flange portion 4A) from which a distance to the side surface 1*a* of the process unit 1 is smallest.

Further, similarly to the second preferred embodiment, at the time of installation of the waste toner tank 100, the waste toner tank 100 and the flange portion 4 (mainly the first flange portion 4A) may preferably be in close contact with each other, as illustrated in FIG. 8. Accordingly, the air blown out of the waste toner tank 100 will be efficiently guided to the flow path 4*a*.

[4] Other Examples

In any of the first to third preferred embodiments, as long as the flow of air from the discharge port 153*b* to the insertion port 1*b* is able to be significantly reduced or prevented, various restricting portions that are not limited to the flange portion 4 may protrude from the discharge pipe 153. In addition, an element to which waste toner is easily attached, such as felt, may be attached to the restricting portion such as the flange portion 4.

Moreover, a lid portion that opens and closes in response to insertion of a cleaning tool may be provided in the insertion port 1*b*. Examples of the lid portion include an opening-and-closing door, a shutter, a short split curtain, and a curtain, for example.

Further, the structures of the components of the image forming apparatus described above are applicable to various image forming apparatuses such as a color multifunctional machine, a color copying machine, and a color printer. In addition, the structures of the components described above are applicable not only to the image forming apparatus for a color image but also to the image forming apparatus for a monochrome image.

The foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. An image forming apparatus comprising: a process unit comprising:

a photoreceptor drum;

a charging portion having an electrode that charges a peripheral surface of the photoreceptor drum;

a cleaning portion including:

a blade that scrapes the toner remaining on the peripheral surface of the photoreceptor drum and;

a discharge pipe that guides the toner that has been collected from the peripheral surface of the photoreceptor drum as waste toner to outside of the process unit, the discharge pipe being protruded from a side surface of the process unit to the outside and;

an insertion port that is provided on the side surface of the process unit and provides access to the electrode of the charging portion from outside of the process unit, wherein the electrode is accessible by a cleaning tool through the insertion port, wherein the discharge pipe includes:

a discharge port that discharges the waste toner, the discharge port provided at a tip portion of a portion of the discharge pipe protruded from the side surface of the process unit to the outside; and a flange portion that is protruded on a peripheral surface of the portion of the discharge pipe protruded from the side surface of the process unit to the outside, between the insertion port and the discharge port.

2. The image forming apparatus according to claim 1, wherein the flange portion extends obliquely around a central axis of the discharge pipe, along the peripheral surface of the discharge pipe, when viewed from a direction perpendicular to the central axis of the discharge pipe.

3. The image forming apparatus according to claim 2, wherein the flange portion extends obliquely around the central axis of the discharge pipe from a position adjacent to the discharge port in such a manner that a part of the flange portion located farther than the position adjacent to the discharge port has a smaller distance from the part to the side surface of the process unit.

4. The image forming apparatus according to claim 3, wherein:

the flange portion and at least one other flange portion are provided in positions spaced from one another in a direction of the central axis of the discharge pipe; and a flow path is formed between the two of the flange portions located adjacent to each other and regulates the flow of air.

5. The image forming apparatus according to claim 4, wherein:

at least one of the flange portions, other than the flange portion from which a distance to the side surface of the process unit is smallest, is provided with a through hole that allows the air to pass; and a flange portion adjacent to the flange portion provided with the through hole on the process unit side, expands to a position capable of receiving a flow of the air having passed the through hole.

6. The image forming apparatus according to claim 2, wherein:

the flange portion and at least one other flange portion are provided in positions spaced from one another in a direction of the central axis of the discharge pipe; and a flow path is formed between the two of the flange portions located adjacent to each other and regulates the flow of air.

7. The image forming apparatus according to claim 6, wherein:

at least one of the flange portions, other than the flange portion from which a distance to the side surface of the process unit is smallest, is provided with a through hole that allows the air to pass; and a flange portion adjacent to the flange portion provided with the through hole on the process unit side, expands to a position capable of receiving a flow of the air having passed the through hole.

8. The image forming apparatus according to claim 1, wherein the insertion port is provided with a lid portion that opens and closes in response to insertion of the cleaning tool for the electrode.

* * * * *